US012480528B2

(12) United States Patent
Namazov et al.

(10) Patent No.: US 12,480,528 B2
(45) Date of Patent: Nov. 25, 2025

(54) METHOD AND SYSTEM FOR HEAVY-DUTY PUMP CARTRIDGE REMOVAL

(71) Applicant: SAUDI ARABIAN OIL COMPANY, Dhahran (SA)

(72) Inventors: Zamig Namazov, Ras Tanura (SA); Bandar Alhazmi, Tanajib (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/488,756

(22) Filed: Oct. 17, 2023

(65) Prior Publication Data

US 2025/0122888 A1 Apr. 17, 2025

(51) Int. Cl.
*F04D 29/62* (2006.01)
*F04D 1/00* (2006.01)

(52) U.S. Cl.
CPC ..... *F04D 29/628* (2013.01); *F04D 1/00* (2013.01)

(58) Field of Classification Search
None
See application file for complete search history.

(56) References Cited

U.S. PATENT DOCUMENTS 4,614,481 A * 9/1986 Vanderjagt ..... F04B 43/026 417/270
11,773,848 B2 * 10/2023 Kondou ..... F04C 15/0003 417/220

FOREIGN PATENT DOCUMENTS

| | | | | |
|---|---|---|---|---|
| CN | 203516214 | U | * | 4/2014 |
| CN | 210623212 | U | * | 5/2020 |
| CN | 111687778 | A | * | 9/2020 |
| CN | 211648599 | U | * | 10/2020 |
| CN | 211805877 | U | * | 10/2020 |
| CN | 213290092 | U | * | 5/2021 |
| CN | 213673903 | U | * | 7/2021 |
| CN | 214237986 | U | * | 9/2021 |
| CN | 215394986 | U | * | 1/2022 |
| CN | 216098691 | U | * | 3/2022 |
| CN | 216422434 | U | * | 5/2022 |
| CN | 217317870 | U | * | 8/2022 |

(Continued)

OTHER PUBLICATIONS

Translation of CN_220740958 (Year: 2024).*

(Continued)

*Primary Examiner* — Jacob J Cigna
(74) *Attorney, Agent, or Firm* — Vorys, Sater, Seymour and Pease, LLP

(57) ABSTRACT

A method of removing a pump cartridge from a centrifugal pump includes arranging a removal plate about the pump cartridge and abutting the removal plate against a casing of the centrifugal pump, inserting a plurality of threaded rods through a plurality of fastener apertures defined in the removal plate and into a plurality of threaded holes in the pump cartridge, advancing a plurality of threaded nuts onto each threaded rod, applying a specified torque to a first set of two or more threaded nuts simultaneously to provide a jacking force to the pump cartridge, applying the specified torque to one or more additional sets of two or more threaded nuts simultaneously to provide an additional jacking force to the pump cartridge, and removing the pump cartridge from the centrifugal pump, wherein the jacking forces translate the pump cartridge through and out of the casing of the centrifugal pump.

9 Claims, 3 Drawing Sheets

(56) References Cited

FOREIGN PATENT DOCUMENTS

| | | | | |
|---|---|---|---|---|
| CN | 115324875 | A | * | 11/2022 |
| CN | 116591997 | A | * | 8/2023 |
| CN | 117145797 | A | * | 12/2023 |
| CN | 220241379 | U | * | 12/2023 |
| CN | 220740958 | U | * | 4/2024 |

OTHER PUBLICATIONS

Translation of CN_213673903 (Year: 2021).*
Machine translation of CN_213290092_U (Year: 2021).*
Gasumov, Ramiz, I. A. Vinnichenko, V. E. Dubenko and N. G. Fedorov. "General principles of modeling operation of a vibrating hammer when removing stuck pipes." Neftyanoe khozyaystvo—Oil Industry (2017): 80-84.

* cited by examiner

METHOD AND SYSTEM FOR HEAVY-DUTY PUMP CARTRIDGE REMOVAL

FIELD OF THE DISCLOSURE

The present disclosure relates generally to centrifugal pump operations and, more particularly, to a method and system for removing stuck pump cartridges during maintenance of centrifugal pumps.

BACKGROUND OF THE DISCLOSURE

Centrifugal pumps are widely used in many industries, and are commonly utilized in oil and gas applications. During the lifespan of a centrifugal pump, the pump cartridge of a centrifugal pump may need to be removed from the pump casing for maintenance or replacement. The removal process for a pump cartridge typically requires special tooling based upon the classification of the centrifugal pump. For example, high-energy centrifugal pumps may require cartridge removal tools which maintain tension on the pump shaft to ensure the hydraulic bundle of the pump cartridge remains rigid. A failure to maintain tension on the pump shaft may lead to damage of the barrel and shaft during cartridge withdrawal, which may lead to costly repairs and may hinder the pump cartridge removal process.

Cartridge removal tools have been developed for applying a systematic (progressive) jacking force to the pump shaft during cartridge removal. Conventional cartridge removal tools utilize two threaded studs on opposing sides of the pump shaft, and a threaded nut is torqued on both studs to slowly jack, or withdraw, the cartridge axially from the pump casing. These cartridge removal tools, however, often fail to provide large enough jacking forces for heavy-duty pumps, and may cause damage to internal components of the pumps. Further, for centrifugal pumps employed in oil and gas applications, sand and other debris may accumulate and cause the centrifugal pumps to seize or stick. In these cases, the jacking forces provided by the traditional cartridge removal tools may fail to overcome the sticking force of the accumulated debris.

Accordingly, a heavy-duty pump cartridge removal tool which can remove stuck pump cartridges is desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method of removing a pump cartridge from a centrifugal pump includes arranging a removal plate about the pump cartridge and abutting the removal plate against a casing of the centrifugal pump, inserting a plurality of threaded rods through a plurality of fastener apertures defined in the removal plate and into a plurality of threaded holes in the pump cartridge, and advancing a plurality of threaded nuts onto each threaded rod. The method further includes applying a specified torque to a first set of two or more threaded nuts simultaneously to provide a jacking force to the pump cartridge, applying the specified torque to one or more additional sets of two or more threaded nuts simultaneously to provide an additional jacking force to the pump cartridge, and removing the pump cartridge from the centrifugal pump, wherein the jacking force and additional jacking force translate the pump cartridge through and out of the casing of the centrifugal pump.

In another embodiment, a system for removing a pump cartridge from a centrifugal pump includes a removal plate having an annular main body defining a central aperture and a plurality of fastener apertures, three or more threaded rods receivable within the plurality of fastener apertures, and three or more threaded nuts receivable on the three or more threaded rods, wherein the main body exhibits an outer diameter greater than or equal to a diameter of a casing of the centrifugal pump, and wherein the central aperture exhibits an inner diameter greater than or equal to an outer diameter of the pump cartridge.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
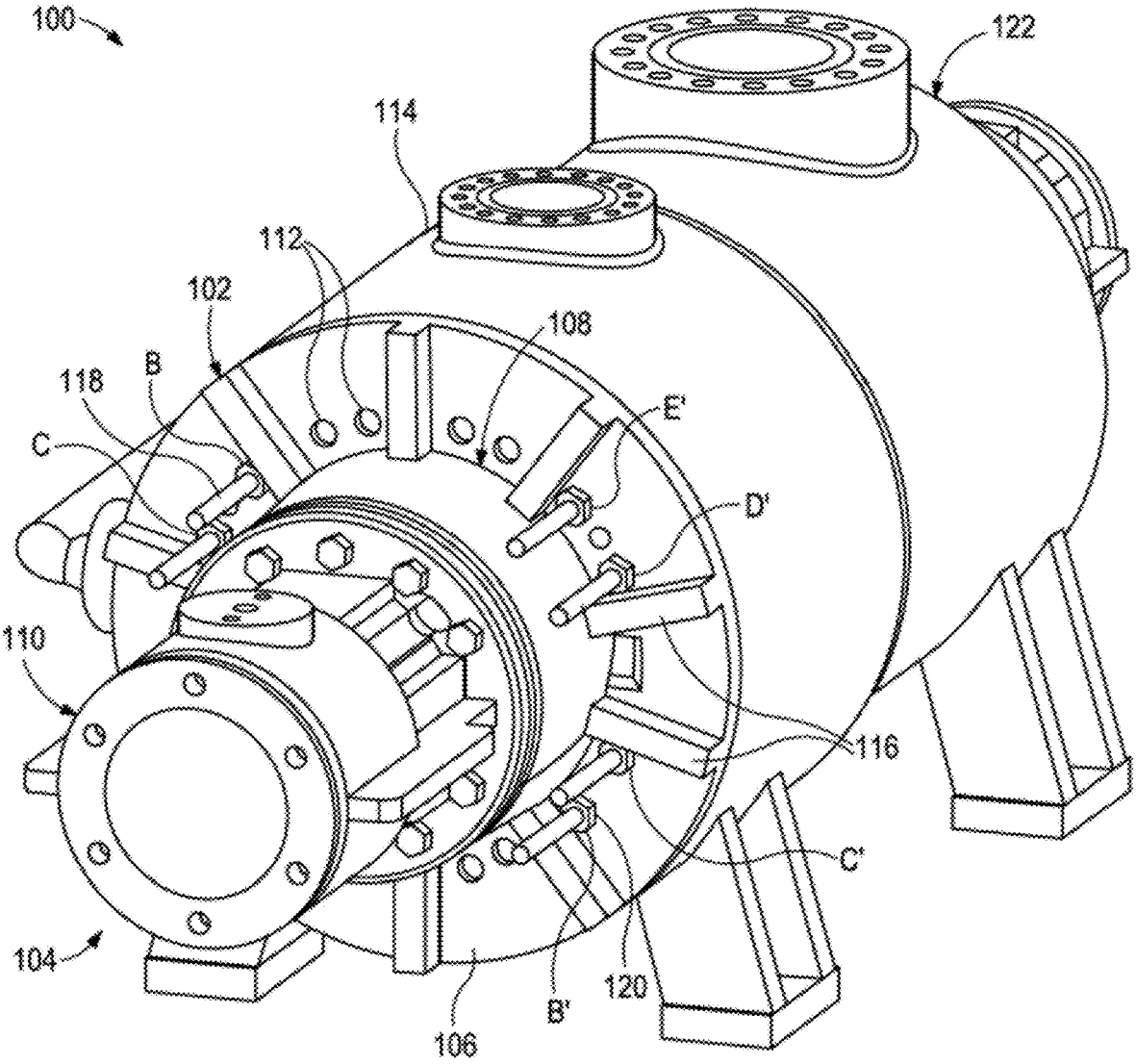
FIG. 1 is a schematic view of an example centrifugal pump that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to centrifugal pump operations and, more particularly, to a method and system for removing stacked pump cartridges during maintenance or operation. Embodiments disclosed herein describe the use of a removal plate for removal of a pump cartridge from a high-energy, heavy-duty, or stuck/seized centrifugal pump. As discussed herein, a method of installing a removal plate on a centrifugal pump and incrementally translating a pump cartridge out of a casing of the centrifugal pump is provided. The embodiments disclosed herein may use three or more threaded rods and nuts as jacking points for application of a jacking force to translate (axially move) the pump cartridge. In at least one embodiment, the removal plate may utilize eight jacking points for application of a large, distributed jacking force to the pump cartridge. The increased number of jacking points distributed around a heavy-duty removal plate may enable removal of high-energy or stuck/seized pump cartridges without damaging any internal components.

FIG. 1 is a schematic view of an example centrifugal pump 100 that may incorporate the principles of the present disclosure. In some embodiments, the centrifugal pump 100 may be a high-energy or heavy-duty centrifugal pump. In further embodiments, the centrifugal pump 100 may be stuck or seized with accumulated debris, such as sand. To enable removal of a pump cartridge 104 of the centrifugal pump 100, a removal plate 102 can be used and installed on the centrifugal pump 100. The pump cartridge 104 may include a pump shaft, one or more seals, one or more bearings, an impeller, a diffuser, an internal magnet, or any combination thereof. In embodiments where the centrifugal pump 100 comprises a high-energy centrifugal pump, the operations and methods described herein may ensure that the pump cartridge 104 is maintained in tension to prevent damage to the internal components of the centrifugal pump 100.

As illustrated, the removal plate 102 may provide a generally annular main body 106 capable of being installed onto the centrifugal pump 100 around (about) the pump cartridge 104. Installing the removal plate 102 may also occlude a suction cover and/or bearing housing (not shown) of the centrifugal pump 100. The main body 106 may be made of a high-strength steel, cast iron, or carbon steel, such that the removal plate 102 may handle high stresses during operation. The main body 106 defines a central aperture 108, through which a drive-end portion 110 of the pump cartridge 104 may enter.

The main body 106 may further define a plurality of fastener apertures 112 that may align with corresponding threaded holes provided on the pump cartridge 104. The main body 106 may be sized such that an outer diameter $\theta_1$ (FIG. 2) may be greater than or equal to an outer diameter of the pump casing 114 of the centrifugal pump 100. The central aperture 108 defined within the main body 106 may be sized such that an inner diameter $\theta_2$ (FIG. 2) may be greater than an outer diameter of the pump cartridge 104. Accordingly, the main body 106 of the removal plate 102 may be capable of passing (extending) over the drive-end portion 110 of the pump cartridge 104 and resting against the end face of the pump casing 114. The plurality of fastener apertures 112 may be defined near the central aperture 108, such that the fastener apertures 112 may align with internal components of the pump cartridge 104 without interference by the thickness of the pump casing 114.

The main body 106 of the removal plate 102 may further include a plurality of raised surfaces 116, shown as fins in the illustrated embodiment, and provided on an exposed face of the main body 106. In some embodiments, the raised surfaces 116 may be evenly distributed (equidistantly spaced) about the exposed face of the main body 106 and may extend from the central aperture 108 to the outer diameter of the removal plate 102. The plurality of raised surfaces 116 may provide additional strength to the main body 106 of the removal plate 102, such that greater stresses may be handled by the removal plate 102 without damage, bending, or wear during operation.

The plurality of fastener apertures 112 may be sized to receive a threaded rod 118 therein, which may be inserted through the fastener aperture 112 and received within (threaded into) a co-axially aligned threaded hole (not shown) defined by the pump cartridge 104. Further, each threaded rod 118 may receive thereon a threaded nut 120 of a corresponding size. In the illustrated embodiment, the threaded nuts 120 have been advanced down the corresponding threaded rod 118 until reaching the exposed face of the main body 106. In some embodiments, the threaded rods 118 may be M24×480 mm screwed rods, and the fastener apertures 112 may be sized accordingly. In these embodiments, the threaded nuts 120 may be M24 hex nuts corresponding to the threaded rods 118. The threaded rods 118 and threaded nuts 120 may be selected as per ASME 31.3 calculations, such that stress calculations are accounted for when choosing these components.

Figure 2:
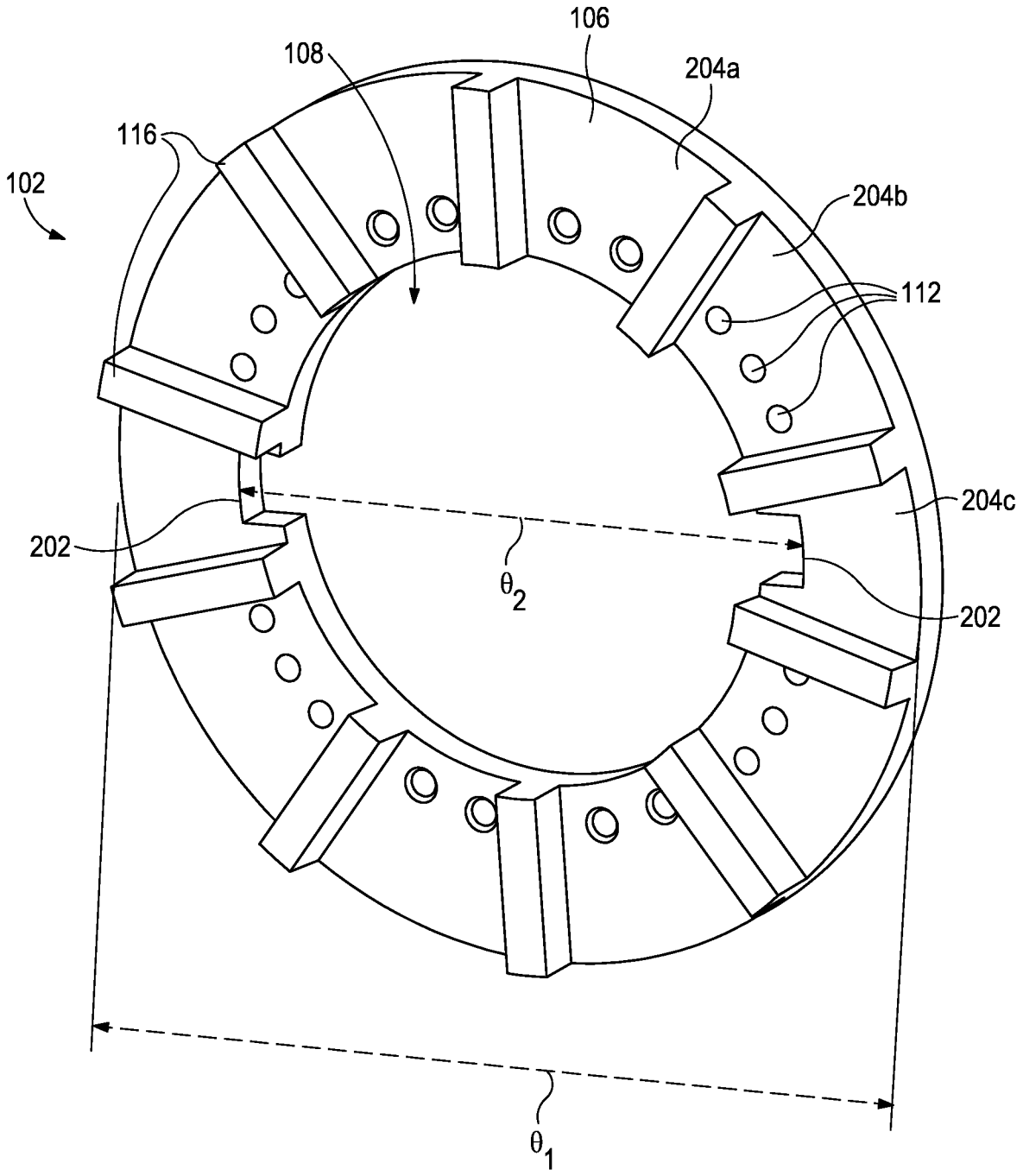
FIG. 2 is an isometric view of the removal plate of FIG. 1, according to an embodiment of the present disclosure.

In conventional removal tools, the pump cartridge 104 is commonly removed using only two threaded rods 118 to advance the pump cartridge 104 through the pump casing 114. For heavy-duty or high-energy centrifugal pumps, however, or for pumps which have accumulated sand or debris and have seized, greater applied forces may be needed. Accordingly, the illustrated embodiment shows the removal plate 102 installed onto the pump cartridge 104 using eight threaded rods 118, such that systematic and progressive jacking forces may be greater and applied in a distributed manner about the circumference of the removal plate 102. In some embodiments, as shown in FIG. 2, the fastener apertures 112 may be angularly spaced from each other in 45° increments from the top-center of the removal plate 102. In such embodiments, the threaded rods 118 may be inserted into the corresponding fastener apertures 112 at 45° increments. In the illustrated embodiment, however, the fastener apertures 112 may be angularly spaced from each other about the circumference of the removal plate 102 and between angularly adjacent raised surfaces 116. In such embodiments, as illustrated, two threaded rods 118 may be inserted into a corresponding two fastener apertures 112 and angularly offset from an additional two threaded rods by 90° around circumference of the removal plate 102.

As discussed further herein, the threaded nuts 120 may be hand-tightened to the surface of the removal plate 102 prior to beginning the process of removing the pump cartridge 104. One or more operators may then simultaneously torque corresponding pairs of threaded nuts 120 which are oppositely located across the pump cartridge 104, such that the corresponding threaded rods 118 are driven. As the threaded nuts 120 are torqued, the removal plate 102 will be unable to advance since it directly engages the end face of the pump casing 114. Accordingly, driving of the threaded rods 118 via the threaded nuts 120 may cause the pump cartridge 104 to move. The use of more than two threaded rods 118 and corresponding threaded nuts 120 may produce a larger jacking force to drive the pump cartridge 104, even if the pump cartridge 104 is stuck or seized with accumulated debris.

As discussed above, the threaded nuts 120 may be advanced (torqued) in matched pairs in opposite positions across the pump cartridge 104. In the illustrated embodiment, for example, the threaded nuts 120 are correspondingly labeled such that B and B' are simultaneously torqued, followed by C and C', D (not shown) and D', and E (not shown) and E'. In some embodiments, each pair of threaded nuts 120 are cycled through and torqued about one-quarter turn (about 90°) simultaneously until the pump cartridge 104 is ultimately removed.

FIG. 2 is an isometric view of an example of the removal plate 102, according to an embodiment of the present disclosure. In the illustrated embodiment, the removal plate 102 is un-installed from the centrifugal pump 100 of FIG. 1, and is shown as an independent component. In the illustrated embodiment, the outer diameter $\theta_1$ of the removal plate 102 may be seen, as well as the inner diameter $\theta_2$ of the central aperture 108. In some embodiments, the central aperture 108 may further include one or more lateral slots 202 extending radially outward and into the main body 106 of the removal plate 102. The lateral slots 202 may be sized to receive protruding portions of the pump cartridge 104 of FIG. 1, for example, and may further be utilized in locating the central aperture 108 over the pump cartridge 104 during initial installation. In some embodiments, the pump casing 114 of the centrifugal pump 100 of FIG. 1 may include an axially split design which includes laterally-protruding bearing housings. In these embodiments, the lateral slots 202 may be sized to receive the laterally-protruding bearing housings for an axially split pump casing 114.

Further, in the illustrated embodiment, the plurality of fastener apertures 112 may be seen such that the cartridge removal process may be facilitated in a plurality of orientations. As shown in FIG. 1, the threaded rods 118 may be inserted in ordered patterns to provide distributed jacking forces to the pump cartridge 104. Accordingly, different sections 204*a-c* of the removal plate 102 provided between angularly adjacent raised surfaces 116 may define different fastener aperture 112 locations and quantities. As shown in the first section 204*a*, two fastener apertures 112 are defined and include countersunk or counter-bored holes. In contrast, the second section 204*b* includes three fastener apertures 112 without any countersunk or counter-bored holes. The third section 204*c* may include only a lateral slot 202 and may not include any fastener aperture 112. The different sections 204*a-c* may be distributed or clustered in patterns around the central aperture 108, such that the second sections 204*b* form a square around the central aperture 108 while the first sections 204*a* flank the top-center and bottom-center of the central aperture 108. Those skilled in the art will readily appreciate that additional sections 204*a-c* of different designs may be utilized, and the pattern of sections 204*a-c* may be varied, without departing from the scope of this disclosure.

Figure 3:
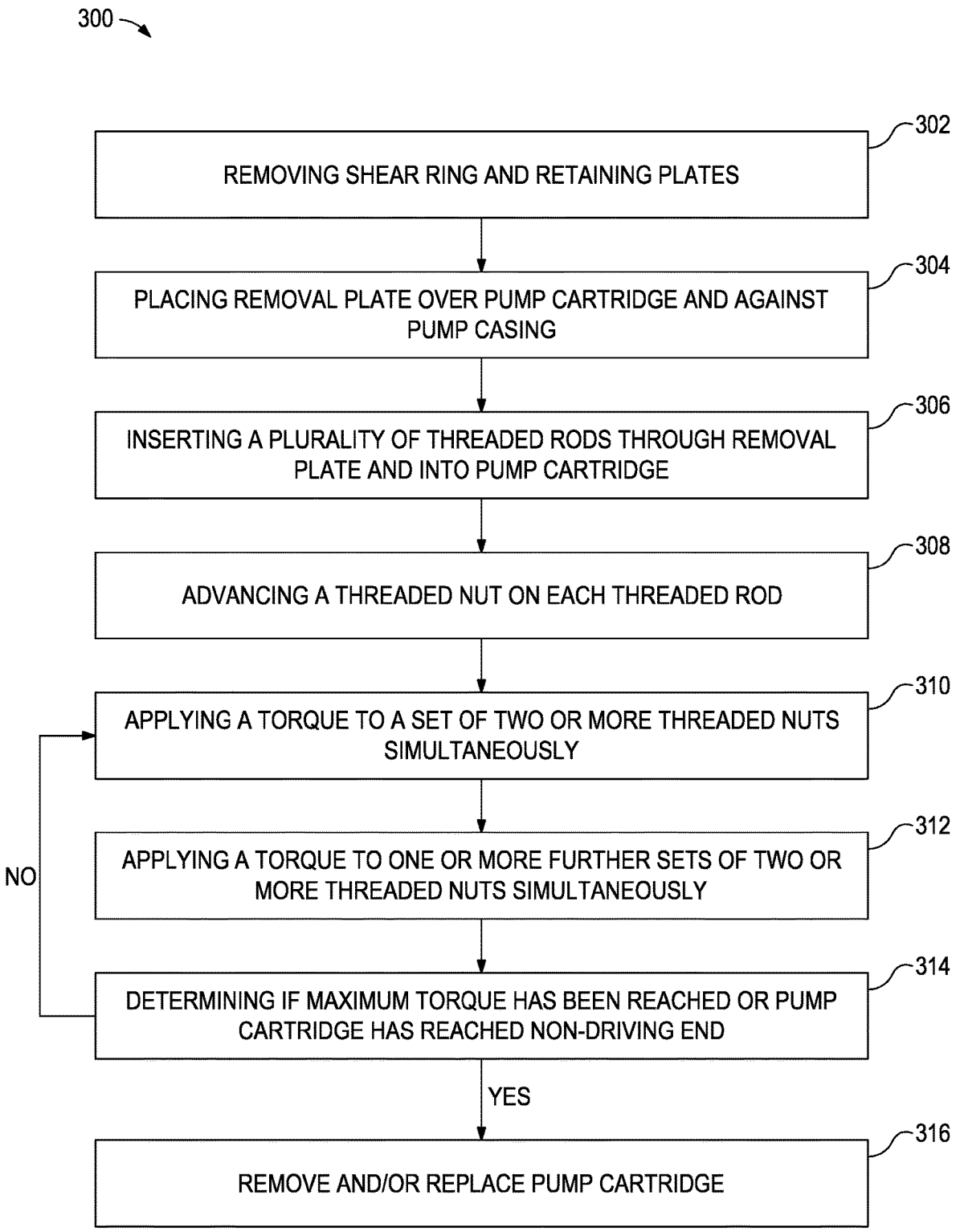
FIG. 3 is a schematic flowchart of an example method for removing a pump cartridge from a pump casing using a removal plate.

FIG. 3 is a schematic flowchart of an example method 300 for removing a pump cartridge (e.g., the pump cartridge 104 of FIG. 1) from a pump casing (e.g., the pump casing 114 of FIG. 1) using a removal plate (e.g., the removal plate 102 of FIGS. 1-2). The method 300 may begin at 302 with removing a shear ring and shear ring retaining plates from the centrifugal pump (e.g., the centrifugal pump 100 of FIG. 1). The illustrated embodiment of FIG. 1 is shown after 302, such that the shear ring and shear ring retaining plates are not shown and have been removed to allow for removal of the pump cartridge. The method 300 may continue at 304 with placing the removal plate over the pump cartridge and against an end face of the pump casing, such that a drive-end portion (e.g., the drive-end portion 110 of FIG. 1) of the pump cartridge may be received through a central aperture 108 (e.g., the central aperture 108 of FIGS. 1-2) of the removal plate. The removal plate may thus surround the pump cartridge, and may be prevented from further forward motion by abutting the end face of the pump casing.

The method 300 may continue at 306 with inserting (advancing) a plurality of threaded rods (e.g., the threaded rods 118 of FIG. 1) through corresponding fastener apertures (e.g., the fastener apertures 112 of FIGS. 1-2). The threaded rods may be inserted through the fastener apertures and threaded into threaded holes defined within the pump cartridge, such that the threaded rods are threadably anchored within the pump cartridge. In some embodiments, three or more threaded rods are inserted at 306, such that increased jacking forces may be applied to the pump cartridge. In further embodiments, eight threaded rods may be inserted through the removal plate at 306 and patterned to distribute the jacking forces evenly around the removal plate. The method 300 may continue at 308 with advancing a threaded nut (e.g., the threaded nut 120 of FIG. 1) on each threaded rod and towards a surface of the main body (e.g., the main body 106 of FIGS. 1-2) of the removal plate. The threaded nuts may be hand-tightened against the removal plate, such that the threaded nuts are prepared for application of a torque wrench or other tool.

The method 300 may continue at 310 with applying torque to a first set of two or more threaded nuts simultaneously. In some embodiments, corresponding torque wrenches may be utilized to apply a specified torque to the two or more threaded nuts, such that fine control of the applied torque and resultant rotation may be monitored and logged. In some embodiments, two operators may simultaneously apply a specified torque to a pair of threaded nuts (e.g., to turn each threaded nut about 90° at a time). In these embodiments, the threaded nuts are symmetrically located across the pump cartridge, such that the jacking force is balanced about the removal plate. In further embodiments, however, three or more threaded nuts may be simultaneously torqued, provided there is adequate space and manpower for the operation. In these embodiments, the three or more threaded nuts may form a regular polygon around the removal plate (an equilateral triangle, a square, a regular pentagon, etc.), such that jacking forces are balanced around the removal plate.

The method 300 may continue at 312 with applying a torque to one or more further sets of two or more threaded nuts simultaneously. In some embodiments, two threaded nuts (a second pair) are torqued at 310 and eight total threaded rods/nuts are utilized. In these embodiments, at 312 each of the remaining three sets of two threaded nuts are torqued in order, such that all remaining threaded nuts have been torqued. Accordingly, the application of torque at 312 may include any number of substeps, such that each remaining set of threaded nuts is torqued the prescribed amount. The combination of applying torque at 310 and 312 may force the removal plate against the pump casing. As the removal plate contacts and is interfered by the pump casing, the jacking forces may continue to drive the threaded rods. Accordingly, the pump cartridge may be translated with respect to a non-driving end (e.g., the non-driving end 122 of FIG. 1) of the centrifugal pump as the threaded nuts are torqued. Further, at 310 and 312, a log may be created and updated to record completion of each partial turn.

The method 300 may continue at 314 with determining if maximum torque conditions have been met. The applied torque for each threaded rod/nut may be recorded and compared to manufacturer recommended values for the threaded rod/nut and the centrifugal pump to prevent damage to the removal plate, centrifugal pump, or additional components. Similarly, a location of the pump cartridge may be monitored to determine if continued torqueing is required. If the maximum torque has not been reached, the method may continue at 310 with application of further torque on the first set of two or more threaded nuts simultaneously. In some embodiments, the method 300 may be performed in an incremental process, such that the pump cartridge is slowly translated by incremental torqueing of the sets of threaded nuts. The incremental, cyclical process may enable close monitoring of the applied torques and location of the pump cartridge to minimize any risk of damage to the removal plate, centrifugal pump, or additional components.

Further, with an increased number of threaded rods used in providing a jacking force, the jacking forces may be kept near-constant as the pump cartridge is advanced. As such, the larger, distributed jacking forces may be utilized in high-energy, heavy-duty, or stuck/seized centrifugal pumps.

If the maximum torque has been reached, the method 300 may continue at 316 with removing and/or replacing the pump cartridge. With the pump cartridge safely translated through the pump casing, the now-accessible pump cartridge may undergo any required maintenance or may be replaced. In some embodiments, the pump cartridge may be cleaned or emptied of any accumulated debris or sand that may have caused the centrifugal pump to stick or seize. Further, at 316, the removal plate may be uninstalled and removed from the centrifugal pump such that the removal plate may be re-used on a further centrifugal pump.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such. While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method of removing a pump cartridge from a centrifugal pump, the method comprising:

locating a central aperture of a removal plate about the pump cartridge via one or more lateral slots defined in a main body of the removal plate to arrange the removal plate about the pump cartridge;

abutting the removal plate against a casing of the centrifugal pump;

inserting a plurality of threaded rods through a plurality of fastener apertures defined in the removal plate and into a plurality of threaded holes in the pump cartridge;

advancing a plurality of threaded nuts onto each threaded rod;

applying a specified torque to a first set of two or more threaded nuts simultaneously to provide a jacking force to the pump cartridge;

applying the specified torque to one or more additional sets of two or more threaded nuts simultaneously to provide an additional jacking force to the pump cartridge; and removing the pump cartridge from the centrifugal pump, wherein the jacking force and additional jacking force translate the pump cartridge through and out of the casing of the centrifugal pump.

2. The method of claim 1, wherein applying the specified torque comprises rotating each threaded nut about 90°.

3. The method of claim 1, wherein the removal plate exhibits an outer diameter greater than or equal to a diameter of the casing of the centrifugal pump, and wherein the central aperture exhibits an inner diameter greater than or equal to an outer diameter of the pump cartridge.

4. The method of claim 1, further comprising determining if a maximum torque has been applied to the first set of two or more threaded.

5. The method of claim 4, further comprising:

applying a further torque to the first set of two or more threaded nuts simultaneously;

applying the further torque to the one or more additional sets of two or more threaded nuts; and re-determining if a maximum torque has been applied to the set of two or more threaded nuts.

6. The method of claim 1, wherein the plurality of threaded rods comprises eight threaded rods and the first set and the one or more additional sets of two or more threaded nuts comprise eight threaded nuts.

7. The method of claim 6, wherein the first set of two or more threaded nuts consists of two threaded nuts, and each of the one or more additional sets of two or more threaded nuts consists of two threaded nuts.

8. The method of claim 1, wherein inserting the plurality of threaded rods through the plurality of fastener apertures comprises inserting the plurality of threaded rods in an equidistantly distributed pattern around the pump cartridge.

9. The method of claim 8, wherein the plurality threaded rods are distributed about every 45° around the removal plate from, and including, a top-center of the removal plate.

* * * * *